United States Patent [19]

Walter

[11] Patent Number: 4,615,170

[45] Date of Patent: Oct. 7, 1986

[54] DEVICES FOR PRODUCING A CONTINUOUS THREAD FROM A ROVING COMPOSED OF PARALLEL SHORT FIBERS

[75] Inventor: Jean-Jacques Walter, Boulogne sur Seine, France

[73] Assignee: Interaction, Paris, France

[21] Appl. No.: 766,866

[22] Filed: Aug. 15, 1985

[30] Foreign Application Priority Data

Aug. 29, 1984 [FR] France ..... 84 13394

[51] Int. Cl.[4] ..... D01H 5/28; D01H 5/26

[52] U.S. Cl. ..... 57/328; 19/236; 19/244; 19/247; 19/248; 57/329; 57/331; 57/350

[58] Field of Search ..... 57/328, 327, 350, 329, 57/315, 330, 333, 331; 19/236, 242, 244, 247, 248

[56] References Cited

U.S. PATENT DOCUMENTS

| | | | |
|---|---|---|---|
| 1,748,712 | 2/1930 | Gminder | 57/329 |
| 1,926,288 | 9/1933 | Koch | 57/329 X |
| 2,091,153 | 8/1937 | Martin | 57/329 |
| 2,206,242 | 7/1940 | Truslow | 57/329 |
| 3,636,591 | 1/1972 | Herubel | 19/236 |
| 3,898,712 | 8/1975 | Blackburn et al. | 19/244 |
| 4,070,732 | 1/1978 | Herubel | 19/236 |

*Primary Examiner*—John Petrakes

*Attorney, Agent, or Firm*—Townsend and Townsend

[57] ABSTRACT

A roving of short fibers is converted to a continuous twisted thread by a device which grips the roving between the facing teeth of two endless belts, and an acoustically generated transverse air jet is directed at the side of the roving, at a fixed point situated between the two belts. The direction of the air jet is reversed each time the fixed point is passed either a pair of facing teeth, or the midpoint in the gap between two successive pairs of facing teeth.

10 Claims, 2 Drawing Figures

DEVICES FOR PRODUCING A CONTINUOUS THREAD FROM A ROVING COMPOSED OF PARALLEL SHORT FIBERS

BACKGROUND OF THE INVENTION

The invention relates to devices for producing a continuous thread from a roving composed of parallel short fibers.

The spinning concerned involves two operations, namely the twisting of the roving and the holding of the fibers during the twisting operation so that they do not become dispersed.

The invention contributes a particularly elegant and effective solution to each of these two problems.

SUMMARY OF THE INVENTION

To this end, the invention resides in a spinning device having two endless toothed belts arranged parallel to one another with their teeth arranged in opposing and abutting pairs to seize the roving in motion therebetween, the distance between successive teeth on each belt being of the order of the fiber length 1. A transverse air current is passed laterally through the roving at a fixed point between the belts. The direction of this air is reversed each time the fixed point is passed either by a pair of abutting teeth or by the midpoint between two successve pairs of abutting teeth.

In preferred embodiments, on or more of the following features is included:

(1) The region surrounding the portion of the roving held between the two belt strands is laterally enclosed by two perforated lateral flanges which permit passage of the air current. The belts and flanges thus define an enclosed space or chamber 13 which preferably has a square cross-section.

(2) The alternating air current is generated by an acoustic vibration generator, which is preferably a loudspeaker associated with a horn which converges towards the above-mentioned fixed point. A duplicate horn, loudspeaker or both may also be included, placed symmetrically with the first with the belts in between.

In addition to these main features, certain other features may also be included, as explained below.

DESCRIPTION OF THE PREFERRED EMBODIMENTS

Figure 1:
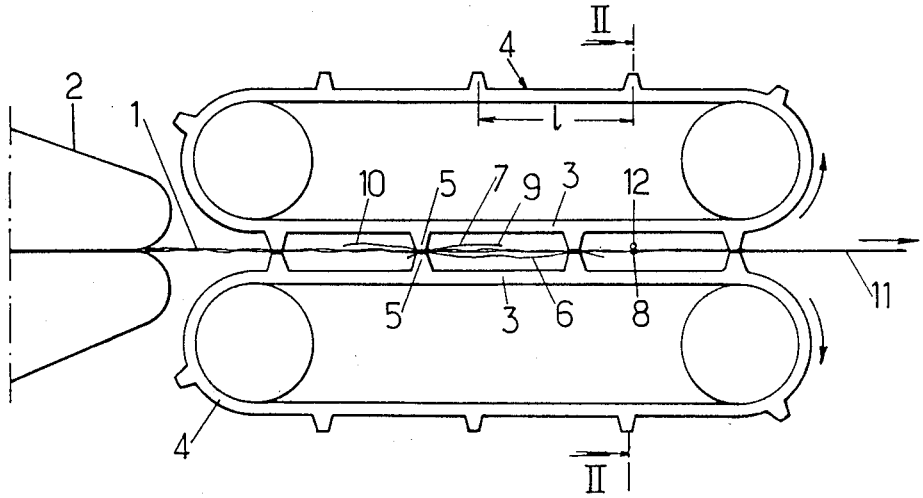
FIG. 1 is a side elevation of a spinning device according to the invention.
Figure 2:
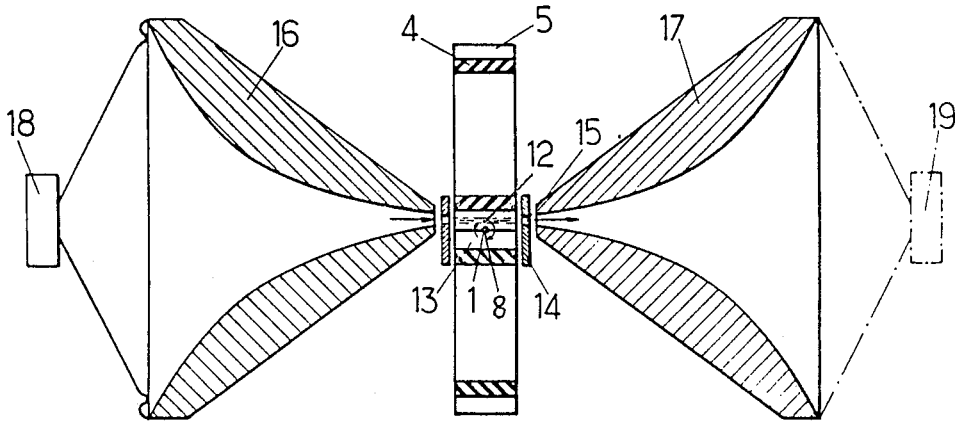
FIG. 2 is a cross-section of the device shown in FIG. 1 taken along the line II—II thereof.

A preferred embodiment of the invention will now be described with reference to the accompanying drawings. This is not intended to limit the invention in any manner.

A roving 1 of parallel fibers is delivered through a roller 2 at a speed V, which is generally between 300 and 1,000 m/min. A speed of approximately 600 m/min is particularly preferred.

The fibers making up the roving are relatively short, their length generally between 20 and 40 mm and preferably of the order of 25 mm.

The roving is seized between the two parallel rectilinear runs 3 of the toothed belts 4 and more precisely between the teeth 5 extending from these runs, with opposing teeth facing each other to form abutting pairs.

The longitudinal dimension of each tooth 5 (i.e., along the direction of motion of the fibers) is relatively small with respect to the distance 1 between successive teeth, preferably about one-tenth thereof.

While certain fibers such as fiber 6 of FIG. 1 may be seized at their ends, most of the fibers, such as fiber 7 of FIG. 1, will be seized at an intermediate point.

The driving speeds of the two endless belts 4 are identical and preferably slightly greater than delivery speed V.

To convert the roving into a strong continuous thread, the fibers, while held between the teeth 5, are twisted by means of a transverse vortex around a fixed point 8 in the path of the roving between the two facing runs 3.

When the front end 9 of a fiber such as above fiber 7 arrives in the vortex, it is drawn into the vortex which winds it around neighboring fibers 6, which are held by their ends. As the teeth 5 gripping the fiber 7 pass beyond the fixed point 8, the rear end 10 of the fiber 7 is twisted by the vortex in the reverse direction and thus wound in its turn around neighboring fibers 6 held at their two ends. The result is a dense and strong twisted thread 11.

The direction of rotation of the vortex must therefore be reversed each time that the fixed point 8 is passed either by a pair of teeth 5, or by a point equidistant from two successive pairs of teeth 5.

A reversible vortex synchronized thus with the toothed belts may be created as follows.

A transverse air stream is directed toward the roving at a fixed point 12 directly above the fixed point 8 level with the roving. To achieve this, the air stream is passed through two holes 15 in the lateral flanges 14 aligned with and on either side of the fixed point 12.

The cross-section of the enclosed space or chamber 13 is preferably square.

The air stream is preferably generated by an acoustic vibration generator.

To this end, the two holes 15 are placed at the convergent ends of two external horns 16 and 17, whose inner surfaces have preferably an exponentially tapering cross-section.

One of these horns 16 is joined at its flared end to the edge of the mouth of a loudspeaker 18.

This loudspeaker is selected so as to emit a sound whose frequency corresponds to the reversing rhythm desired for the air stream at 12.

This frequency preferably ranges from 200 to 800 Hz.

The horn 16 is arranged so that the acoustic wave generated by the loudspeaker 18 is gradually concentrated in approaching the corresponding hole 15 with a maximum amplitude at the level of this hole to produce a violent air jet between the two holes 15 and through the fixed point 12.

Upon emerging from the enclosed space, the air jet enters the horn 17 and is converted again by the divergent form of this horn into an air current of low speed and of large cross-section.

Since the air jet is eccentric with respect to the center of the chamber 13 and the chamber is square or approximately square, the air jet forms a vortex around the roving 1 at the point 8.

Synchronizing the changes of direction of the vortex with the portions of the belts is preferably achieved by sensing the position of the teeth 5 and sending a signal based on their position to a power source for the loudspeaker 18.

A simple device for sensing the position of the teeth is a photoelectric cell arranged so that its luminous energizing beam is intercepted by the passage of the teeth 5.

The rotary speed of the vortex may be regulated by modifying the amplitude of the acoustic wave emitted by the loudspeaker, which amplitude in turn depends on the strength of the electrical current which supplies the loudspeaker.

A second loudspeaker 19 can be mounted on the horn 17 symmetrically with the loudspeaker 18. The acoustic wave generating the vortex is then generated by both loudspeakers 18 and 19, which are tuned to the same frequency but with a relative phase difference of one half period.

Regardless of the embodiment adopted, the device of the present invention produces a continuous and strong twisted thread 11 at the outlet of the belts. The thread 11 may be collected in any conventional manner, particularly by reeling.

The invention is not intended to be limited to the specific embodiments described herein. Modifications within the spirit and scope of the invention will be readily apparent to those skilled in the art.

I claim:

1. Apparatus for producing a continuous thread from a roving supplied at a preselected delivery speed, said apparatus comprising:

two endless toothed belts arranged with facing run sections and the teeth on one aligned with those on the other hand along said facing run sections, the teeth on each said belt spaced apart by a distance approximately equal to the average length of the fibers of said roving;

means for passing an air current transverse to said roving at a fixed point between said facing run sections; and means for reversing the direction of said air current when said fixed point is passed by a pair of aligned teeth.

2. Apparatus for producing a continuous thread from a roving supplied at a preselected delivery speed, said apparatus comprising:

two endless toothed belts arranged with facing run sections and the teeth on one aligned with those on the other along said facing run sections, the teeth on each said belt spaced apart by a distance approximately equal to the average length of the fibers of said roving;

means for passing an air current transverse to said roving at a fixed point between said facing run sections; and means for reversing the direction of said air current when said fixed point is passed by a point between successive pairs of aligned teeth and equidistant therefrom.

3. Apparatus according to claim 1 or 2, further comprising means for rotating said belts such that said facing run sections travel at a speed slightly greater than said preselected delivery speed.

4. Apparatus according to claim 1 or 2, further comprising a pair of lateral flanges adjacent to said facing run sections and defining therewith a chamber around said roving, said lateral flanges being perforated to allow passage of said air stream.

5. Apparatus according to claim 4, wherein said chamber has a square cross-section.

6. Apparatus according to claim 1 or 2, wherein said air stream is generated by an acoustic vibration generator.

7. Apparatus according to claim 6, wherein said acoustic vibration generator is comprised of a loudspeaker associated with a horn converging toward said fixed point.

8. Apparatus according to claim 6, wherein said acoustic vibration generator includes first and second horns on opposing sides of said facing run sections, each said horn converging toward said fixed point.

9. Apparatus according to claim 8, wherein said acoustic vibration generator further includes first and second loud speakers associated with said first and second horns, respectively, said first and second loudspeakers being tuned to the same frequency but out of phase by a half period.

10. Apparatus according to claims 1 or 2, wherein the distance between adjacent teeth on each belt is between 20 to 40 mm and said air current passing means includes a loud-speaker adapted to emit a sound having a frequency between 200 and 800 Hz.

* * * * *